US005512139A

United States Patent [19]

Worcester

[11] Patent Number: 5,512,139

[45] Date of Patent: Apr. 30, 1996

[54] METHOD AND DEVICE FOR MAKING TISSUE

[75] Inventor: Brian J. Worcester, Janesville, Wis.

[73] Assignee: Beloit Technologies, Inc., Wilmington, Del.

[21] Appl. No.: 164,515

[22] Filed: Dec. 8, 1993

[51] Int. Cl.[6] ..... D21G 3/04

[52] U.S. Cl. ..... 162/111; 162/198; 162/281; 162/262; 162/263; 162/252; 118/100

[58] Field of Search ..... 162/111, 198, 162/280, 281, 262, 263, 252; 428/153; 118/100

[56] References Cited

U.S. PATENT DOCUMENTS

| | | | |
|---|---|---|---|
| 3,040,807 | 11/1959 | Chope | 162/252 |
| 4,462,868 | 7/1984 | Oubridge et al. | 162/280 |
| 4,919,756 | 4/1990 | Sawdai | 162/111 |
| 5,026,458 | 6/1991 | Beuther | 162/198 |
| 5,269,846 | 12/1993 | Eskelinen et al. | 118/100 |
| 5,269,883 | 12/1993 | Bewther | 162/198 |

*Primary Examiner*—Donald E. Czaja
*Assistant Examiner*—Jose A. Fortuna
*Attorney, Agent, or Firm*—Dirk J. Veneman; Raymond W. Campbell; David J. Archer

[57] ABSTRACT

A doctor cooperates with the peripheral surface of a Yankee dryer for peeling the tissue away from the peripheral surface such that when the tissue is peeled from the surface, a series of microfolds are generated in the resultant tissue. An adjusting mechanism is connected to the doctor for adjusting an angle defined between the doctor and the peripheral surface. The arrangement is such that when the angle is adjusted, the physical dimensions of the microfolds change. A sensor is disposed downstream relative to the doctor for sensing the physical dimensions of the microfolds. A control circuit is electrically connected to the sensor and responsive to the sensor. The control circuit is electrically connected to the adjusting mechanism for varying the angle of the doctor so that the physical dimensions of the microfolds are optimized.

9 Claims, 2 Drawing Sheets

METHOD AND DEVICE FOR MAKING TISSUE

BACKGROUND OF THE INVENTION

1. Field of the Invention

The present invention relates to an apparatus for making tissue. More specifically, the present invention relates to means for adjusting the angle defined between a doctor and a peripheral surface of a Yankee dryer for controlling the physical dimensions of microfolds generated during peeling of the tissue from the Yankee dryer.

2. Information Disclosure Statement

In the manufacture of tissue paper grades, the tissue is creped from a Yankee dryer by means of a doctor. Such creping generates a series of microfolds, or macrofolds, which are formed in the sheet in order to attain the optimal level of stretch for converting and softness for quality.

The tissue sheet is typically peeled off the Yankee dryer by the use of a steel or ceramic blade. The angle at which the aforementioned blade or crepe doctor is set at greatly impacts the crepe quality of the sheet. The highest crepe quality is attained by putting the smallest length microfolds into the sheet at high frequency and by assuring a level crepe profile across the width of the tissue sheet coming to the reel downstream relative to the Yankee dryer.

Control of creping normally requires time-consuming, difficult changes to the doctor holder and conforming types of holders. Until recently, operators did not have the means for adjusting the crepe angle as the crepe blade wore down. Consequently, as the blade wears, the crepe angle changes. Subsequently, as the blade angle changes, so does the quality of crepe generated in the sheet. Since Yankee doctor blades are typically changed once or twice during a shift during normal operation, it is clearly evident that tissue sheet quality changes frequently during the course of a day.

A recent modification to a Yankee doctor allows for on-the-run manual adjustment of the crepe doctor angle. However, tissue quality measurements are time-consuming, and adjustments of the crepe angle is frequently late and inaccurate. Moreover, the adjustments are still done manually, which requires operator attention in a dusty environment.

The present invention solves the aforementioned problem by adding a device that is able to read crepe in the tissue sheet. Such is done by measuring both the length and the height of each microfold. The device, according to the present invention, is able to work at a single location, or alternatively, to traverse across the width of the tissue paper machine. The apparatus, according to the present invention, permits the transmittal of information to a control unit. The control unit houses an algorithm that controls the crepe angle. The control unit is also capable of transmitting information to an adjustable angle crepe doctor. Upon receiving the signal from the control unit, the crepe angle will be changed instantaneously to adjust for process changes, such as blade wear, furnish changes, uneven Yankee coating, uneven moisture profile and a myriad of other changes which impact crepe uniformity and quality.

The present invention is designed to run in closed loop mode but will also be capable of running with manual adjustments. Since information on crepe uniformity and crepe quality are instantaneously available, the operator of the apparatus will be able to make more timely manual adjustments to the adjustable angle crepe doctor.

Therefore, it is a primary objective of the present invention to provide an apparatus which permits automatic control of the angle of a doctor so that the physical dimensions of the generated microfolds is optimized.

Other objects and advantages of the present invention will be readily apparent to those skilled in the art by a consideration of the detailed description contained hereinafter, taken in conjunction with the annexed drawings.

SUMMARY OF THE INVENTION

The present invention relates to an apparatus and method for making tissue.

The apparatus includes a Yankee dryer having a peripheral surface for supporting the tissue. A doctor cooperates with the peripheral surface for peeling the tissue away from the peripheral surface such that when the tissue is peeled from the peripheral surface, a series of microfolds are generated in the resultant tissue.

Adjusting means are connected to the doctor for adjusting an angle defined between the doctor and the peripheral surface. The arrangement is such that when the angle is adjusted, the physical dimensions of the microfolds change.

Sensor means are disposed downstream relative to the doctor for sensing the physical dimensions of the microfolds.

Additionally, control means are electrically connected to the sensor means and are responsive to the sensor means. The control means are electrically connected to the adjusting means for varying the angle of the doctor so that the physical dimensions of the microfolds are optimized.

Many variations and modifications of the present invention will be readily apparent to those skilled in the art by a consideration of the detailed description contained hereinafter, taken in conjunction with the annexed drawings. However, such modifications and variations fall within the spirit and scope of the present invention as defined by the appended claims.

BRIEF DESCRIPTION OF THE DRAWINGS

Similar reference characters refer to similar parts throughout the figures of the drawings.

DETAILED DESCRIPTION OF THE DRAWINGS

Figure 1:
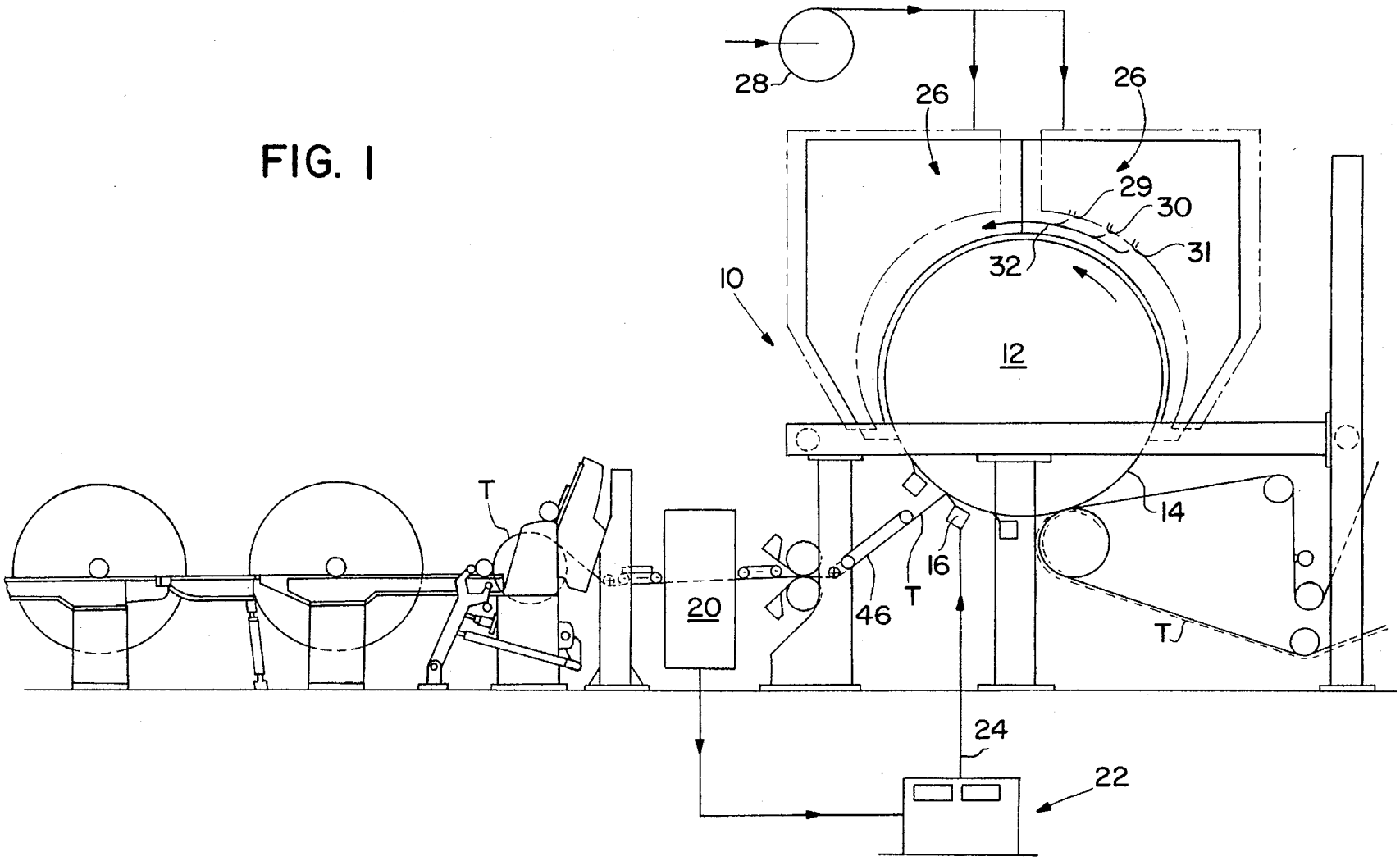
FIG. 1 a side-elevational view of a Yankee dryer having a variable angle doctor and a sensor means disposed downstream relative to the doctor.

FIG. 1 is a side-elevational view of an apparatus, generally designated 10, for making tissue T. The apparatus 10 includes a Yankee dryer 12 having a peripheral surface 14 for supporting the tissue T.

A doctor 16 cooperates with the peripheral surface 14 for peeling the tissue T away from the peripheral surface 14 such that when the tissue T is peeled from the peripheral surface 14, a series of microfolds are generated in the resultant tissue.

Figure 2:
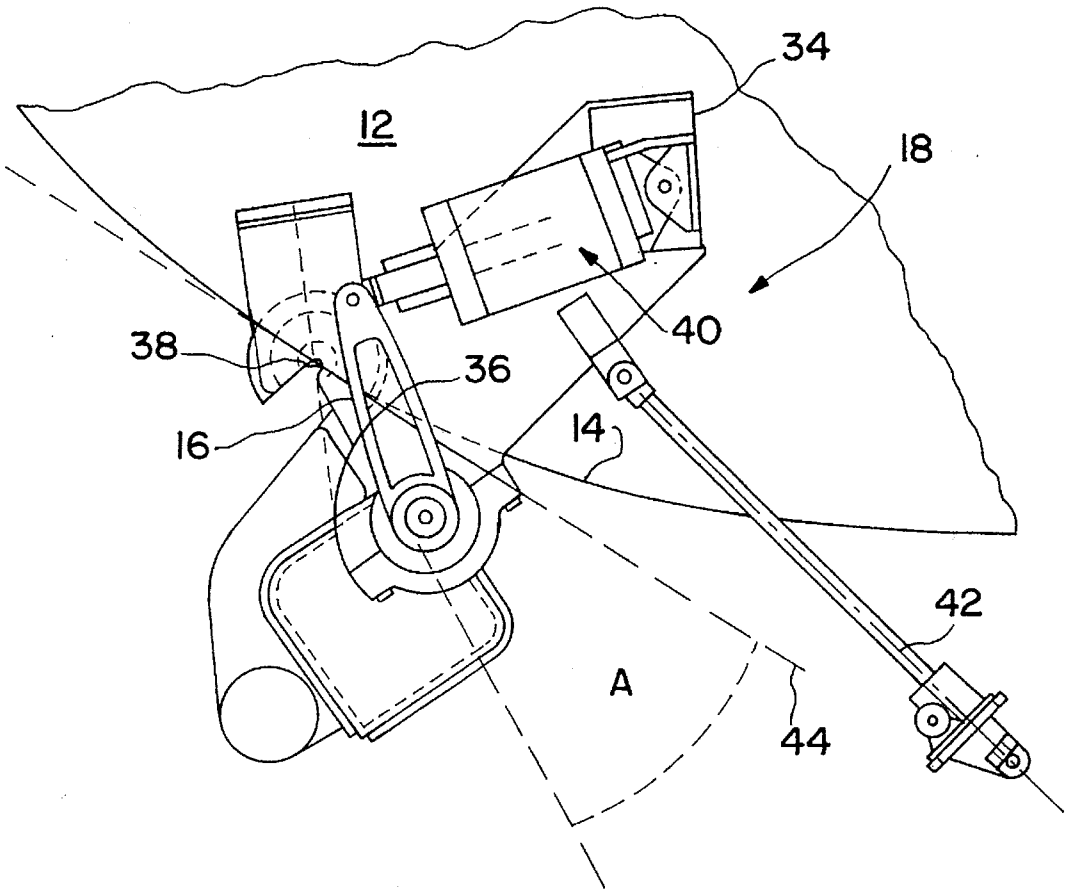
FIG. 2 is an enlarged view of a portion of FIG. 1 showing the variable angle doctor.

FIG. 2 is an enlarged side-elevational view of the doctor 16 shown in FIG. 1. The doctor 16 includes adjusting means, generally designated 18, connected to the doctor 16 for adjusting an angle A defined between the doctor 16 and the peripheral surface 14. The arrangement is such that when the angle A is adjusted, the physical dimensions of the microfolds change.

Sensor means, generally designated 20, are disposed downstream relative to the doctor 16 for sensing the physical dimensions of the microfolds.

Additionally, control means, generally designated 22, are electrically connected to the sensor means 20 and are responsive to the sensor means 20. The control means 22 is electrically connected by line 24 to the adjusting means 18 for varying the angle A of the doctor 16 so that the physical dimensions of the microfolds are optimized.

In a more specific embodiment of the present invention, the Yankee dryer 12 has a diameter within the range 10–30 foot, and preferably has a diameter of 18 foot.

Additionally, the apparatus 10 also includes hood means 26 which encircle a portion of the peripheral surface 14. The hood means 26 are connected to a source of pressurized air 28. The hood means 26 define a plurality of orifices 29,30 and 31 disposed adjacent to the peripheral surface 14 for the flow therethrough, as indicated by the arrow 32, of the pressurized air such that in use of the apparatus 10, high velocity air 32 flows from the hood means 26 towards the tissue T supported on the peripheral surface 14.

The doctor 16 also includes a frame 34 and a blade 36 adjustably secured to the frame 34 such that a distal end 38 of the blade 36 bears against the peripheral surface 14 so that the tissue T supported on the peripheral surface 14 is peeled therefrom by the blade 36.

The adjusting means 18 includes motor means 40 for moving the blade 36 relative to the frame 34 and means 42 for moving the frame 34 relative to the peripheral surface 14 such that adjustment of the angle A between the blade 36 and a tangent 44 of the peripheral surface 14 at the distal end 38 of the blade 36 is permitted.

The sensor means 20 generates a signal which is proportional to the physical dimensions of the microfolds. The signal is received by the control means 22.

Preferably, the signal is within the range 4–20 mA.

In one embodiment of the present invention, the sensor means 20 is movable transversely across the tissue T for sensing the microfolds.

The control means 22 includes an electrical circuit having an algorithm capable of responding to the signal from the sensor means 20. The control means 22 generates a control signal in response to the signal from the sensor means 20 for controlling the angle A of the doctor 16 relative to the peripheral surface 14.

In an alternative embodiment of the present invention, the control means includes manual means connected to the doctor 16 for permitting manual adjustment of the doctor 16 responsive to the signal from the sensor means 20. Such manual adjustment varies the angle A between the doctor 16 and the peripheral surface 14.

In operation of the present invention, the web T leaves the Yankee dryer 12 after being creped off by the adjustable angle crepe doctor 16. The web traverses under a static foil 46 which provides sheet support. The crepe of the tissue is read by sensor 20, which is disposed at the general location of the basis weight and moisture sensors.

Additionally, it will be appreciated by those skilled in the art that the crepe sensor could be mounted on the sensor that senses the basis weight and moisture measurement.

The sensor 20 sends a signal, typically within the range 4–20 mA, to the control unit 22. The control unit interprets the signal, and after performing calculations to determine the impact on the crepe angle A, it sends a signal to the adjustable crepe doctor 16 to change the crepe angle.

Alternatively, the operator would be able to check the read-out from the sensor 20 and make manual adjustments to the crepe doctor 16 if such is deemed necessary.

It will be understood by those skilled in the art that the concept of the present invention could be applied equally as a retrofit to existing machines, as well as to new machines.

The present invention provides a unique system which allows the tissue manufacturer to attain, for a given furnish, the best stretch and softness.

What is claimed is:

1. An apparatus for making tissue, said apparatus comprising:

a Yankee dryer having a peripheral surface for supporting the tissue;

a doctor cooperating with said peripheral surface for peeling the tissue away from said peripheral surface such that when the tissue is peeled from said peripheral surface, a series of microfolds are generated in the resultant tissue;

adjusting means connected to said doctor for adjusting an angle defined between said doctor and said peripheral surface, the arrangement being such that when said angle is adjusted, the physical dimensions of said microfolds change;

sensor means disposed downstream relative to said doctor for sensing said physical dimensions of said microfolds;

control means electrically connected to said sensor means and responsive to said sensor means, said control means being electrically connected to said adjusting means for varying said angle of said doctor so that said physical dimensions of said microfolds are optimized;

said doctor further including:

a frame;

a blade adjustably secured to said frame such that a distal end of said blade bears against said peripheral surface so that the tissue supported on said peripheral surface is peeled therefrom by said blade; and said adjusting means including:

motor means for moving said blade relative to said frame and for moving said frame relative to said peripheral surface such that adjustment of said angle between said blade and a tangent of said peripheral surface at said distal end of said blade is permitted, the arrangement being such that said blade pivots about said distal end of said blade.

2. An apparatus for making tissue as set forth in claim 1, wherein said Yankee dryer has a diameter within the range 10–30 feet.

3. An apparatus for making tissue as set forth in claim 1, further including:

hood means encircling a portion of said peripheral surface, said hood means being connected to a source of pressurized air, said hood means defining a plurality of orifices disposed adjacent to said peripheral surface for the flow therethrough of said pressurized air such that in use of said apparatus, high velocity air flows from said hood means towards the tissue supported on said peripheral surface.

4. An apparatus for making tissue as set forth in claim 1, wherein said sensor means is movable transversely across the tissue for sensing said microfolds.

5. An apparatus for making tissue as set forth in claim 1, wherein said sensor means generates a signal which is proportional to said physical dimensions of said microfolds, said signal being received by said control means.

6. An apparatus for making tissue as set forth in claim 5, wherein said signal is within the range 4–20 mA.

7. An apparatus for making tissue as set forth in claim 5, wherein said control means includes:

an electrical circuit having an algorithm capable of responding to said signal from said sensor means, said control means generating a control signal in response to said signal from said sensor means for controlling said angle of said doctor relative to said peripheral surface.

8. An apparatus for making tissue as set forth in claim 5, wherein said control means includes:

manual means connected to said doctor for permitting manual adjustment of said doctor responsive to said signal from said sensor means, such manual adjustment varying said angle between said doctor and said peripheral surface.

9. A process for making tissue, said process comprising the steps of:

supporting the tissue on a peripheral surface of the Yankee dryer; peeling the tissue away from the peripheral surface of the Yankee dryer by means of a doctor which cooperates with the peripheral surface such that a series of microfolds are generated in the resultant tissue;

said doctor further including;

a frame:

a blade adjustable secured to said frame such that a distal end of said blade bears against said peripheral surface;

adjusting an angle defined between said doctor and said peripheral surface such that when the angle is adjusted, the physical dimensions of the microfolds change; sensing the physical dimensions of the microfolds downstream relative to the doctor by means of a sensor, the sensor generating a signal proportional to the physical dimensions of the microfolds; receiving the signals generated by the sensor, such signals being received by a control circuit; analyzing the signals received by the control circuit and generating a control signal for adjusting the angle defined between the doctor and the peripheral surface so that the physical dimensions of the microfolds are optimized; and wherein the step of adjusting the angle includes pivoting the doctor about a distal end of the doctor by moving said blade relative to said frame and moving said frame relative to said peripheral surface.

* * * * *